US011545794B2

(12) United States Patent
Kim et al.

(10) Patent No.: US 11,545,794 B2
(45) Date of Patent: Jan. 3, 2023

(54) CONNECTOR ASSEMBLY

(71) Applicants: HYUNDAI MOTOR COMPANY, Seoul (KR); KIA CORPORATION, Seoul (KR); YURA CO., LTD., Hwaseong-si (KR)

(72) Inventors: Ji Hyoung Kim, Gunpo-si (KR); Jung Nan Ryu, Gunpo-si (KR); Ki Hui Nam, Suwon-si (KR); Seoung Ho Jung, Yongin-si (KR)

(73) Assignees: HYUNDAI MOTOR COMPANY, Seoul (KR); KIA CORPORATION, Seoul (KR); YURA CO., LTD., Hwaseong-si (KR)

( * ) Notice: Subject to any disclaimer, the term of this patent is extended or adjusted under 35 U.S.C. 154(b) by 0 days.

(21) Appl. No.: 17/240,556

(22) Filed: Apr. 26, 2021

(65) Prior Publication Data

US 2022/0131321 A1 Apr. 28, 2022

(30) Foreign Application Priority Data

Oct. 27, 2020 (KR) ..... 10-2020-0140560

(51) Int. Cl.

| | |
|---|---|
| ***H01R 13/66*** | (2006.01) |
| ***H01R 13/7193*** | (2011.01) |
| ***H01R 12/58*** | (2011.01) |
| ***H01R 13/436*** | (2006.01) |

(52) U.S. Cl.

CPC ..... *H01R 13/7193* (2013.01); *H01R 12/585* (2013.01); *H01R 13/4367* (2013.01); *H01R 13/665* (2013.01); *H01R 2201/26* (2013.01)

(58) Field of Classification Search

CPC .. H01R 13/719; H01R 24/64; H01R 13/7195; H01R 43/00; H01R 13/6658; H01R 13/6625; H01R 13/7197

See application file for complete search history.

(56) References Cited

U.S. PATENT DOCUMENTS

| | | | | |
|---|---|---|---|---|
| RE31,929 E * | 6/1985 | Donaher | ..... | H05K 7/1092 439/70 |
| 4,930,200 A * | 6/1990 | Brush, Jr. | ..... | H01R 13/7195 29/25.42 |
| 5,219,305 A * | 6/1993 | Kawaguchi | ..... | H01R 13/7197 439/108 |
| 5,286,221 A * | 2/1994 | Fencl | ..... | H01R 13/658 439/607.53 |

(Continued)

FOREIGN PATENT DOCUMENTS

KR 10-2018-0044090 5/2018

*Primary Examiner* — Truc T Nguyen

(74) *Attorney, Agent, or Firm* — Lempia Summerfield Katz LLC

(57) ABSTRACT

A connector assembly includes: a housing having a first side at which a plurality of accommodating grooves configured to receive a plurality of terminals are formed, and having a second side open; a plurality of connection terminals extending in a direction parallel to a direction from the first side of the housing toward the second side of the housing, and fixed in the housing; a circuit board inserted into the second side of the housing that is open, fixed to the housing, and electrically connected to the plurality of connection terminals; and noise filters configured to filter out electromagnetic interference and coupled to the circuit board.

12 Claims, 8 Drawing Sheets

(56) References Cited

U.S. PATENT DOCUMENTS

| | | | | |
|---|---|---|---|---|
| 5,823,827 | A * | 10/1998 | Belopolsky | H01R 13/6666 439/620.06 |
| 7,547,217 | B1 * | 6/2009 | Lin | H01R 13/6658 439/76.1 |
| 8,113,882 | B1 * | 2/2012 | Chen | H01R 13/6581 439/607.01 |
| 8,231,411 | B1 * | 7/2012 | Westman | H01R 13/6471 439/607.05 |
| 8,690,607 | B2 | 4/2014 | Tsukamoto et al. | |
| 8,992,259 | B2 | 3/2015 | Miwa et al. | |
| 10,498,094 | B2 | 12/2019 | Tsukamoto | |
| 10,651,604 | B2 | 5/2020 | Tsukamoto | |
| 2003/0211782 | A1 * | 11/2003 | Esparaz | H01R 13/6658 439/620.11 |
| 2006/0276064 | A1 * | 12/2006 | Takimura | H01R 12/725 439/108 |
| 2013/0084720 | A1 * | 4/2013 | Chang | H01R 13/6658 439/83 |
| 2022/0095453 | A1 * | 3/2022 | Choi | H05K 1/0266 |

* cited by examiner

CONNECTOR ASSEMBLY

CROSS REFERENCE TO RELATED APPLICATION

The present application claims priority to and the benefit of Korean Patent Application No. 10-2020-0140560, filed on Oct. 27, 2020, the entire contents of which are incorporated herein by reference.

FIELD

The present disclosure relates to a connector assembly.

BACKGROUND

The statements in this section merely provide background information related to the present disclosure and may not constitute prior art.

Recently, various electronic devices have been developed. Such an electronic device includes a housing formed of an insulating material, and a connector formed in the housing and including terminals formed of a conductive material, and the terminals are electrically connected by the connector to form a circuit.

In particular, information is transferred to a joint connector applied to wiring of a vehicle through controller area network (CAN) in a vehicle, and a large amount of information is transferred to a communication joint connector for a vehicle safety and convenience system.

Further, malfunction is caused by noise generated in a transmitted signal due to an increased communication speed resulting from the change into controller area network with flexible data-rate (CAN FD).

According to the related art, technologies, in which a ferrite bead is embedded in a connector to remove noise in CAN FD communication, have been developed. However, as a distance between terminals increases to mount the ferrite bead between the terminals, the volume and weight of the connector assembly increase.

The matters described as the related art have been provided only for assisting in the understanding for the background of the present disclosure and should not be considered as corresponding to the related art known to those skilled in the art.

SUMMARY

The present disclosure provides a connector assembly in which ferrite beads are coupled to a circuit board to remove noise transferred through terminals.

According to one form of the present disclosure, a connector assembly includes: a housing having a first side at which a plurality of accommodating grooves into which a plurality of terminals are insertable are formed, and having a second side open; a plurality of connection terminals extending in a direction parallel to a direction from the first side of the housing toward the second side of the housing, and fixed in the housing; and a circuit board inserted into the second side of the housing that is open, fixed to the housing, electrically connected to the plurality of connection terminals, and to which noise filters that filter out electromagnetic interference are coupled.

The circuit board may have a plurality of connection holes, and one end portions of the connection terminals may be electrically connected to the circuit board in a state of penetrating through the connection holes.

The one end portion of the connection terminal may be inserted into the connection hole while being in an elastically deformed state, and adhere an inner circumferential surface of the connection hole by an elastic force.

A plurality of connection holes may be formed in the circuit board while being spaced apart from each other in a plane direction, and the noise filters may be in a form of a plurality of beads positioned between the plurality of connection holes that are spaced apart from each other.

The connector assembly may further include an insertion fixing unit integrally fixed to the circuit board while enclosing the circuit board, inserted into the second side of the housing that is open, and fixed to the housing.

The circuit board may have a plurality of connection holes, and the insertion fixing unit may have guide holes penetrating toward an inside of the housing at positions corresponding to the plurality of connection holes.

The guide hole may be tapered so as to be gradually expanded while extending from the circuit board toward the inside of the housing.

A locking fixing portion that protrudes upward so that a portion of the locking fixing portion that faces an inner side of the housing is tapered and a portion of the locking fixing portion that faces an outer side of the housing is stepped may be formed on an upper surface of the insertion fixing unit, and a locking rotation portion having a locking hole into which the locking fixing portion is inserted as the insertion fixing unit is inserted into the second side of the housing may be formed on an upper surface of the housing.

One end portion of the locking rotation portion may be rotatably coupled to the upper surface of the housing, and the other end portion of the locking rotation portion may be tapered upward.

The connector assembly may further include a terminal position assurance (TPA) mechanism inserted into the housing in a direction intersecting a direction in which the accommodating grooves extend and inhibiting the plurality of terminals inserted into the accommodating grooves from being separated.

The connection terminal may be inserted from the second side of the housing that is open toward the first side of the housing, and the connection terminal may have an expanded portion that is expanded outward to block insertion into the housing at a preset position.

A protrusion that protrudes outward and comes into contact with the housing may be formed on the connection terminal, and the protrusion may be formed so that a portion that faces the first side of the housing is tapered and a portion that faces the second side of the housing is stepped.

The noise filters may be ferrite cores that filter out noise included in a signal input to or output from the circuit board through the plurality of connection terminals.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
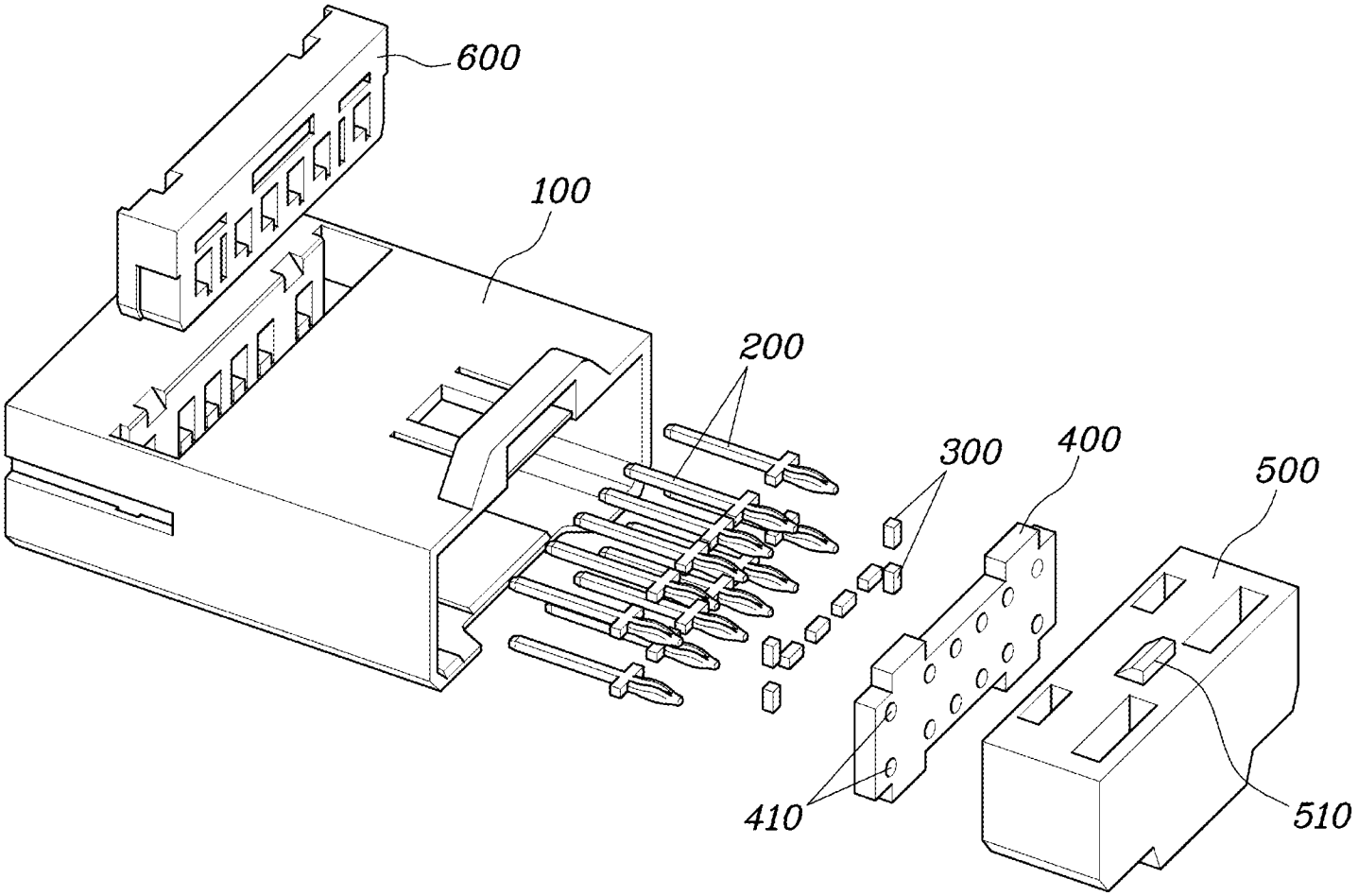
FIG. 1 is an exploded perspective view of a connector assembly according to one form of the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

Since forms of the present disclosure may be variously modified and may have several forms, specific forms will be shown in the accompanying drawings and will be described in detail in the present specification or disclosure. However, it is to be understood that the present disclosure is not limited to specific forms, but includes all modifications, equivalents, and substitutions included in the spirit and the scope of the present disclosure.

Terms such as "first", "second", etc., may be used to describe various components, but the components are not to be construed as being limited to the terms. The terms are used only to distinguish one component from another component. For example, the "first" component may be named the "second" component and the "second" component may also be similarly named the "first" component, without departing from the scope of the present disclosure.

It is to be understood that when one element is referred to as being "connected to" or "coupled to" another element, it may be connected directly to or coupled directly to another element or be connected to or coupled to another element, having the other element intervening therebetween. On the other hand, it is to be understood that when one element is referred to as being "connected directly to" or "coupled directly to" another element, it may be connected to or coupled to another element without the other element intervening therebetween. Other expressions describing a relationship between components, that is, "between", "directly between", "neighboring to", "directly neighboring to" and the like, should be similarly interpreted.

Terms used in the present specification are used only in order to describe specific forms rather than limiting the present disclosure. Singular forms used herein are intended to include plural forms unless context explicitly indicates otherwise. It will be further understood that the terms "comprise" or "have" used in this specification, specify the presence of stated features, steps, numerals, operations, components, parts, or a combination thereof, but do not preclude the presence or addition of one or more other features, numerals, steps, operations, components, parts, or a combination thereof.

Unless indicated otherwise, it is to be understood that all the terms used in the specification including technical and scientific terms have the same meaning as those that are understood by those who skilled in the art. It must be understood that the terms defined by the dictionary are identical with the meanings within the context of the related art, and they should not be ideally or excessively formally defined unless the context clearly dictates otherwise.

Hereinafter, various forms of the present disclosure will be described in detail with reference to the accompanying drawings. Like reference numerals proposed in each drawing denote like components.

Figure 2:
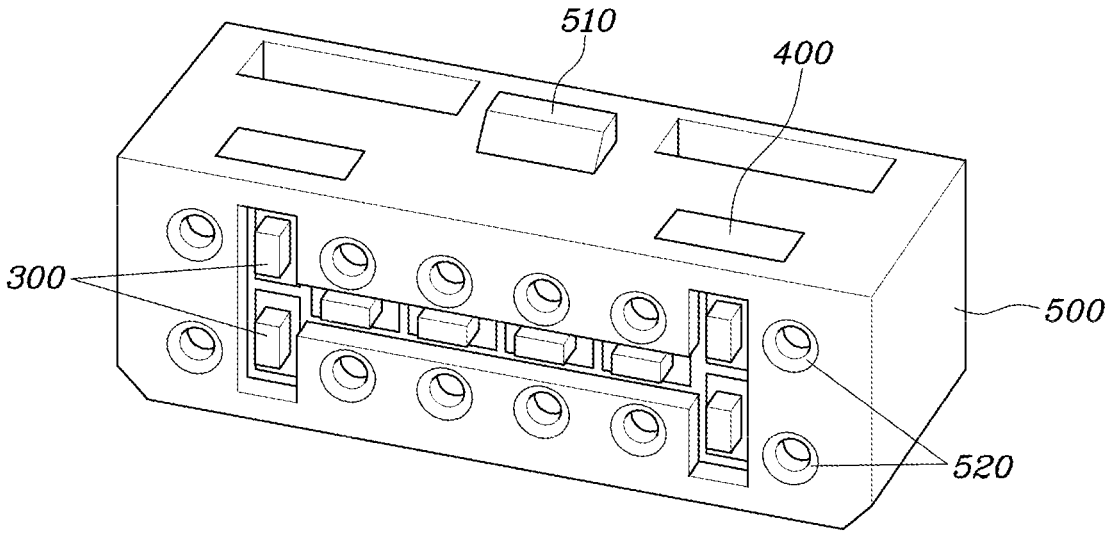
FIG. 2 is a perspective view of an insertion fixing unit to which a circuit board is coupled according to one form of the present disclosure.

FIG. 1 is an exploded perspective view of a connector assembly according to one form of the present disclosure, and FIG. 2 is a perspective view of an insertion fixing unit 500 to which a circuit board 400 is coupled according to one form of the present disclosure.

Referring to FIGS. 1 and 2, the connector assembly according to one form of the present disclosure includes: a housing 100 having one side at which a plurality of accommodating grooves 110 into which a plurality of terminals F are insertable are formed, and having the other side formed with an opening; a plurality of connection terminals 200 extending in a direction parallel to a direction from the one side of the housing 100 toward the other side of the housing 100, and fixed in the housing 100; and a circuit board 400 inserted into the opening of the other side of the housing 100, fixed to the housing 100, electrically connected to the plurality of connection terminals 200, and to which noise filters 300 that filter out electromagnetic interference are coupled.

The plurality of accommodating grooves 110 may be formed in one side surface of the housing 100. The plurality of accommodating grooves 110 may be recessed inward at the one side surface of the housing 100, extend parallel to each other, and be spaced apart from each other at the one side surface of the housing 100.

The other side of the housing 100 that is opposite to the one side surface of the housing 100 may be open. The circuit board 400 or the insertion fixing unit 500 to be described later, to which the circuit board 400 is coupled, may be coupled to the other side of the housing 100.

The plurality of connection terminals 200 may be inserted into the housing 100. In particular, the plurality of connection terminals 200 may extend in the direction from the one side of the housing 100 to the other side of the housing 100, may extend in a direction parallel to a direction in which the accommodating grooves 110 of the housing 100 extend, and may be disposed at positions corresponding to the accommodating grooves 110. As described later, the plurality of connection terminals 200 may be inserted from the other side that is open toward the one side.

Particularly, the plurality of connection terminals 200 may be electrically connected to the plurality of terminals F inserted at the one side of the housing 100.

The circuit board 400 may be a board to which electrically connected circuits are coupled or on which electrically connected circuits are formed. According to one form, the circuit board 400 may be a printed circuit board (PCB) or a flexible printed circuit (FPC).

The circuit board 400 may be fixed to the housing 100 in a state of being inserted into the other side of the housing 100 that is open. In particular, the circuit board 400 may cover the other side of the housing 100 that is open. The circuit board 400 may be directly coupled to the housing 100 or the circuit board 400 fixed to the insertion fixing unit 500 to be described later may be coupled to the housing 100.

The circuit board 400 may be electrically connected to the plurality of connection terminals 200 positioned in the housing 100. In particular, the plurality of connection terminals 200 may be in physical contact with the circuit board 400, and the circuit board 400 may include a circuit connected to the plurality of connection terminals 200 that are in physical contact with the circuit board 400.

The noise filters 300 are components that filter out electromagnetic interference, and may be coupled to the circuit board 400. The noise filters 300 may be ferrite cores that filter out noise included in a signal input to or output from the circuit board 400 through the plurality of connection terminals 200.

The circuit board 400 may have a plurality of connection holes 410, and one end portions of the connection terminals 200 may be electrically connected to the circuit board 400 in a state of penetrating through the connection holes 410.

The connection terminals 200 may be electrically connected to the circuit board 400 through the one end portions. In particular, an outer circumferential surface of the one end portion of the connection terminal 200 may be in physical contact with the connection hole 410 in a state where the connection terminal 200 penetrates through the connection hole 410 formed in the circuit board 400. Therefore, a signal input or output through the connection terminal 200 may be transferred through the connection hole 410.

The one end portion of the connection terminal 200 may be inserted into the connection hole 410 while being in an elastically deformed state, and may adhere an inner circumferential surface of the connection hole 410 by an elastic force.

The one end portion of the connection terminal 200 may be elastically deformed inward in a circumferential direction, and may be inserted into the connection hole 410 by being elastically deformed. In the one end portion of the connection terminal 200 inserted into the connection hole 410 by being elastically deformed, the elastic force may be applied outward in the circumferential direction. The one end portion of the connection terminal 200 adheres the inner circumferential surface of the connection hole 410 by the elastic force, and thus the connection terminal 200 may be electrically connected to the circuit board 400.

The noise filters 300 may be in a form of a plurality of beads positioned between the plurality of connection holes 410 spaced apart from each other. The noise filters 300 may be in a form of a plurality of beads, and may be coupled to the circuit board 400. In particular, the noise filters 300 that are in a form of separated beads may be disposed between the plurality of connection holes 410.

That is, the noise filter 300 may be a ferrite bead formed of a ferrite core.

According to one form, the noise filters 300 that are in a form of a plurality of beads may be coupled to the circuit board 400 by soldering. Further, the noise filters 300 may be electrically connected to the circuit board 400.

Therefore, reflected waves or noise of a signal input or output through the connection terminal 200 connected to the connection hole 410 may be removed by the noise filters 300.

The connector assembly may further include the insertion fixing unit 500 integrally fixed to the circuit board 400 while enclosing the circuit board 400, inserted into the other side of the housing 100 that is open, and fixed to the housing 100.

According to one form, the insertion fixing unit 500 may be formed by performing resin injection molding in a state where the circuit board 400 is inserted. According to another form, the insertion fixing unit 500 may be integrally coupled to the circuit board 400. For example, the circuit board 400 may be coupled in a state where the circuit board 400 is inserted into the insertion fixing unit 500 through a lower surface of the insertion fixing unit 500 that is open.

The insertion fixing unit 500 may be integrally coupled to the circuit board 400 or formed integrally with the circuit board 400. The insertion fixing unit 500 may accommodate the noise filters 300 therein, and at the same time, may serve as a holder that supports the one end portions of the inserted connection terminals 200.

The circuit board 400 may have the plurality of connection holes 410, and the insertion fixing unit 500 may have guide holes 520 penetrating toward the inside of the housing 100 at positions corresponding to the plurality of connection holes 410.

Therefore, the one end portions of the connection terminals 200 may be electrically connected to the circuit board 400 in a state of penetrating through both the guide holes 520 and the connection holes 410.

In particular, the guide hole 520 may be tapered so as to be gradually expanded while extending from the circuit board 400 toward the inside of the housing 100. Specifically, the cross-sectional area of the guide hole 520 may gradually increase toward the inside of the housing 100, and thus, an inner circumferential surface of the guide hole 520 may be tapered.

Therefore, as the insertion fixing unit 500 is inserted into the other side of the housing 100, the connection terminal 200 inserted into the housing 100 is inserted into the guide hole 520, and the insertion of the connection terminal 200 may be guided by the guide hole 520 whose cross-sectional area increases toward the inside of the housing 100.

Figure 3:
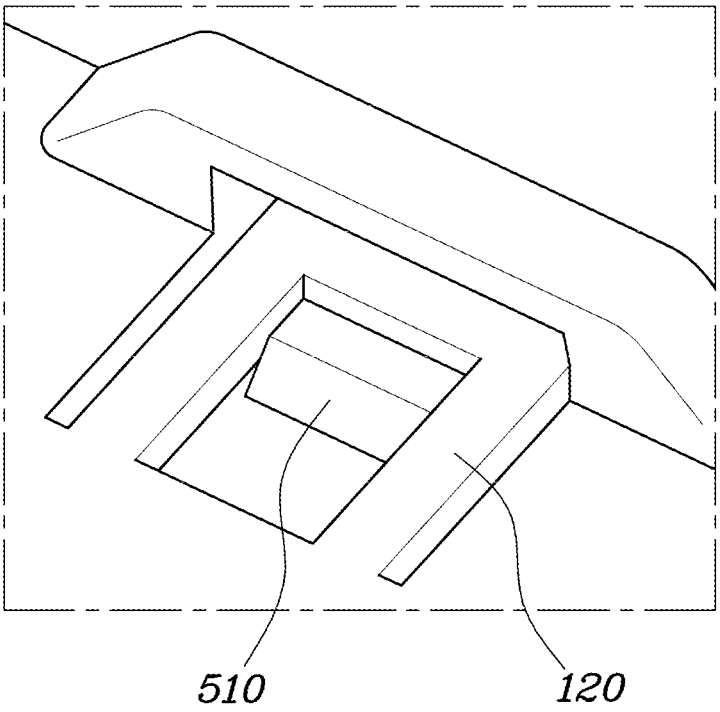
FIG. 3 is a view illustrating coupling between a housing and the insertion fixing unit according to one form of the present disclosure.

FIG. 3 is a view illustrating coupling between the housing 100 and the insertion fixing unit 500 according to one form of the present disclosure.

Referring to FIG. 3, the insertion fixing unit 500 may be inserted into the other side of the housing 100 that is open, and fixed to the housing 100. The insertion fixing unit 500 may be inserted while sliding at the other side of the housing 100, and the inserted insertion fixing unit 500 may be inhibited from being separated.

Specifically, a locking fixing portion 510 protruding upward so that a portion of the locking fixing portion 510 that faces an inner side of the housing 100 is tapered and a portion of the locking fixing portion 510 that faces an outer side of the housing 100 is stepped may be formed on an upper surface of the insertion fixing unit 500, and a locking rotation portion 120 having a locking hole into which the locking fixing portion 510 is inserted as the insertion fixing unit 500 is inserted into the other side of the housing 100 may be formed on an upper surface of the housing 100.

In the locking fixing portion 510 protruding upward on the upper surface of the insertion fixing unit 500, a tapered surface is formed in a direction in which the locking fixing portion 510 is inserted into the housing 100, and a surface that faces the outer side of the housing 100 may be stepped.

The locking rotation portion 120 may be formed on the upper surface of the housing 100 so as to correspond to the locking fixing portion 510. The locking rotation portion 120 may rotate based on a fixed one end portion, and the other end portion of the locking rotation portion 120 may move upward by the locking fixing portion 510 as the insertion fixing unit 500 is inserted into the housing 100, and then move downward. In a state where the other end portion moves downward, the locking rotation portion 120 may inhibit the insertion fixing unit 500 and the locking fixing portion 510 from being separated.

Further, the one end portion of the locking rotation portion 120 may be rotatably coupled to the upper surface of the housing 100, and the other end portion of the locking rotation portion 120 may be tapered upward.

The one end portion of the locking rotation portion 120 may be connected and fixed to the upper surface of the housing 100, the other end portion of the locking rotation portion 120 is exposed as a free end, and opposite end portions between the one end portion and the other end portion may be separate from the upper surface of the housing 100. Therefore, the locking rotation portion 120 may be rotatably coupled to the upper surface of the housing 100 based on the one end portion.

In addition, the other end portion of the locking rotation portion 120 may have an upwardly tapered shape. Specifically, the other end portion of the locking rotation portion 120 may have a lower surface that is upwardly inclined toward the outer side. Therefore, it is possible to guide the locking rotation portion 120 to rotate by the locking fixing portion 510 as the insertion fixing unit 500 slides in a direction in which the insertion fixing unit 500 is inserted into the other side of the housing 100.

The connector assembly may further include a terminal position assurance (TPA) mechanism 600 inserted into the housing 100 in a direction intersecting the direction in which the accommodating grooves 110 extend and inhibiting the plurality of terminals F inserted into the accommodating grooves 110 from being separated.

The TPA mechanism 600 is a component inserted into the housing 100, and may be inserted in the direction intersecting the direction in which the accommodating grooves 110 into which the terminals F are inserted extend according to one form. The TPA mechanism 600 may inhibit the terminals T inserted into the accommodating grooves 110 from being separated.

Figure 4:
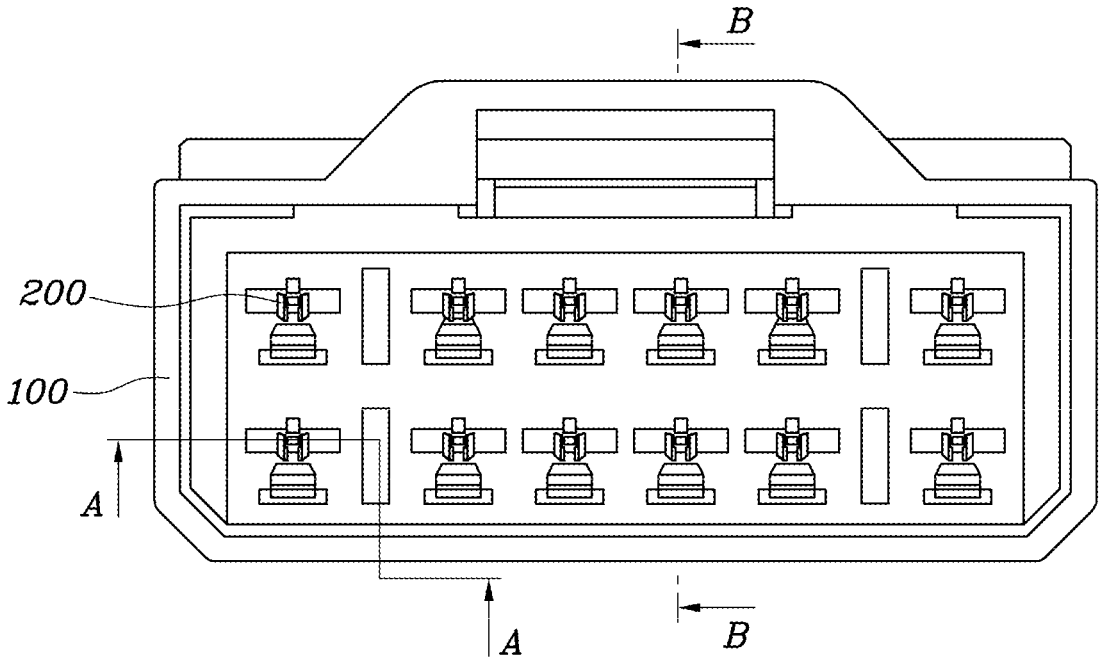
FIG. 4 is a plan view of the other side of the housing according to one form of the present disclosure.
Figure 5:
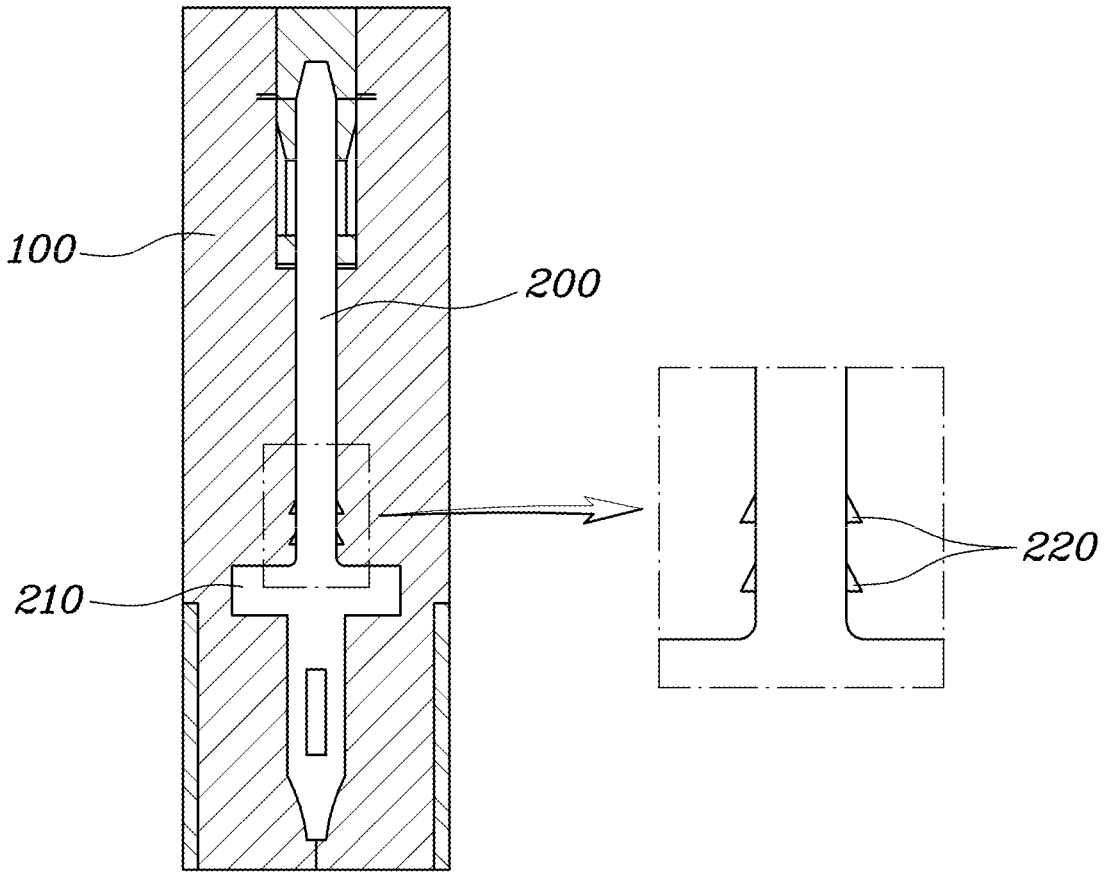
FIGS. 5 and 6 are cross-sectional views of FIG. 4.
Figure 6:
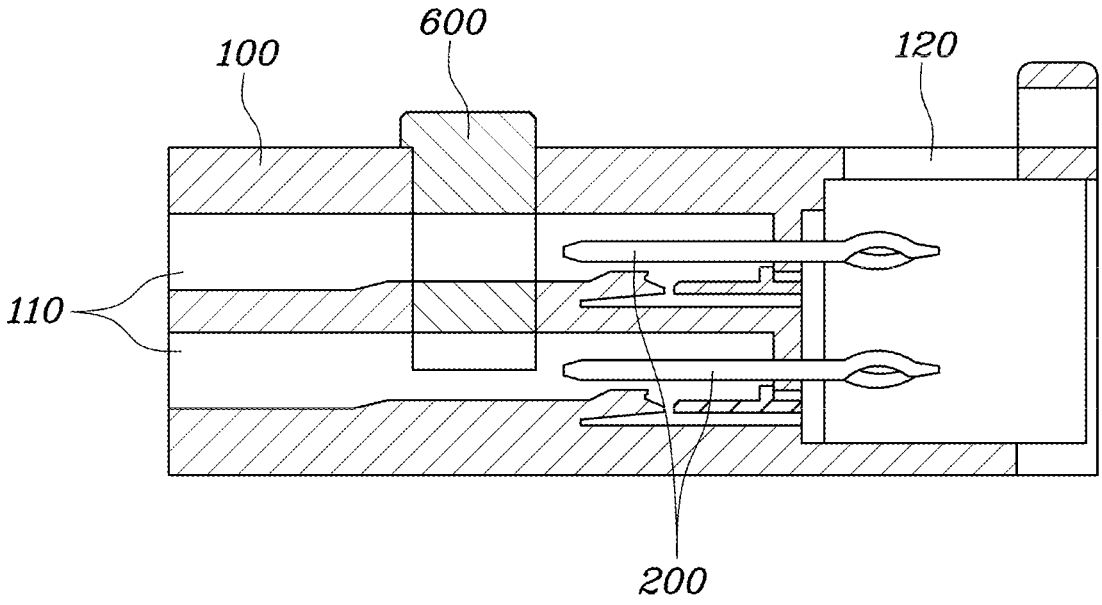

FIG. 4 is a plan view of the other side of the housing 100 according to one form of the present disclosure, and FIGS. 5 and 6 are cross-sectional views of FIG. 4.

Referring to FIGS. 4 to 6, the connection terminal 200 may be inserted from the other side of the housing 100 that is open toward the one side of the housing 100, and the connection terminal 200 has an expanded portion 210 that is expanded outward to block insertion into the housing 100 at a preset position.

The expanded portion 210 that is expanded outward may be formed between the one end portion and the other end portion of the connection terminal 200. The connection terminal 200 may be inserted into the other side of the housing 100 toward the one side of the housing 100 and fixed in the housing 100. Particularly, the connection terminal 200 may be inserted up to a position where the expanded portion 210 of the connection terminal 200 is locked to block sliding.

Further, a protrusion 220 that protrudes outward and comes into contact with the housing 100 may be formed on the connection terminal 200, and the protrusion 220 may be formed so that a portion that faces the one side of the housing 100 is tapered and a portion that faces the other side of the housing 100 is stepped.

According to one form, a plurality of protrusions 220 may be arranged along a length direction in which the connection terminal 200 extends. Further, the protrusion 220 may come into contact with the housing 100 as the connection terminal 200 is inserted. The protrusion 220 may be positioned more adjacent to the one side of the housing 100 than the expanded portion 210 is.

The protrusion 220 may be formed in an inclined shape so that a surface that faces the one side of the housing 100 is tapered, and a surface of the protrusion 220 that faces the other side of the housing 100 may be stepped. Therefore, the sliding of the connection terminal 200 toward the one side of the housing 100 may be allowed, and the sliding of the connection terminal 200 toward the other side of the housing 100 may be blocked.

Figure 7:
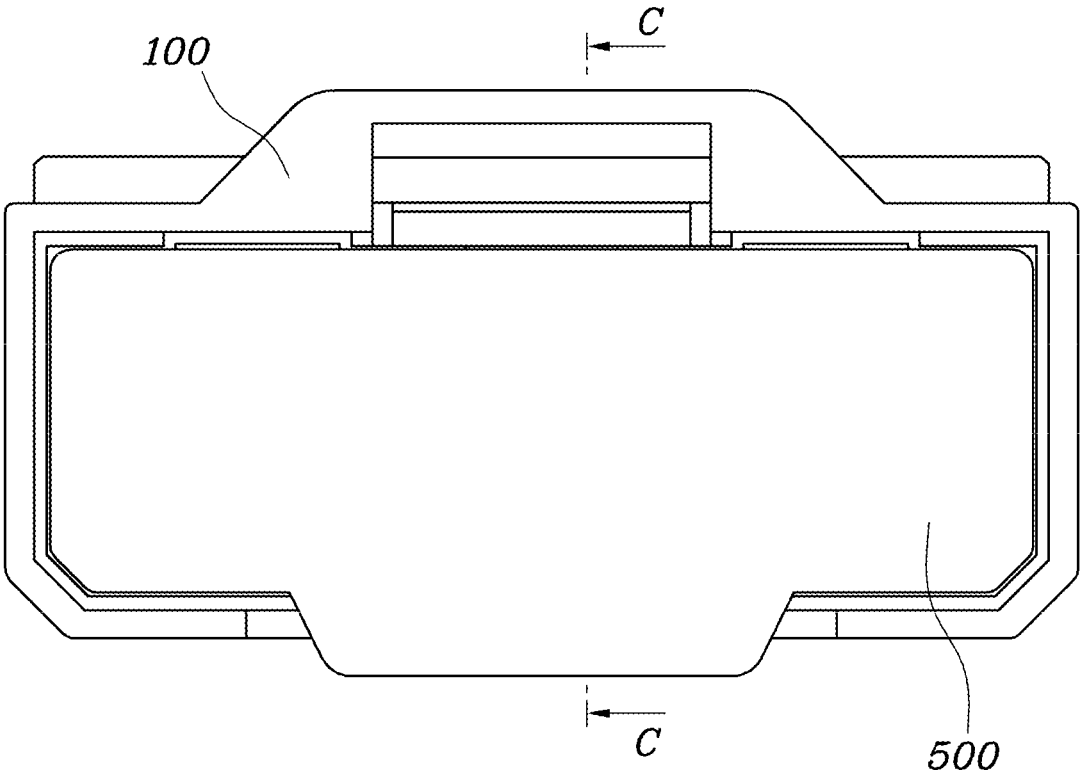
FIG. 7 is a plan view of the other side of the housing into which the insertion fixing unit is inserted according to one form of the present disclosure.
Figure 8:
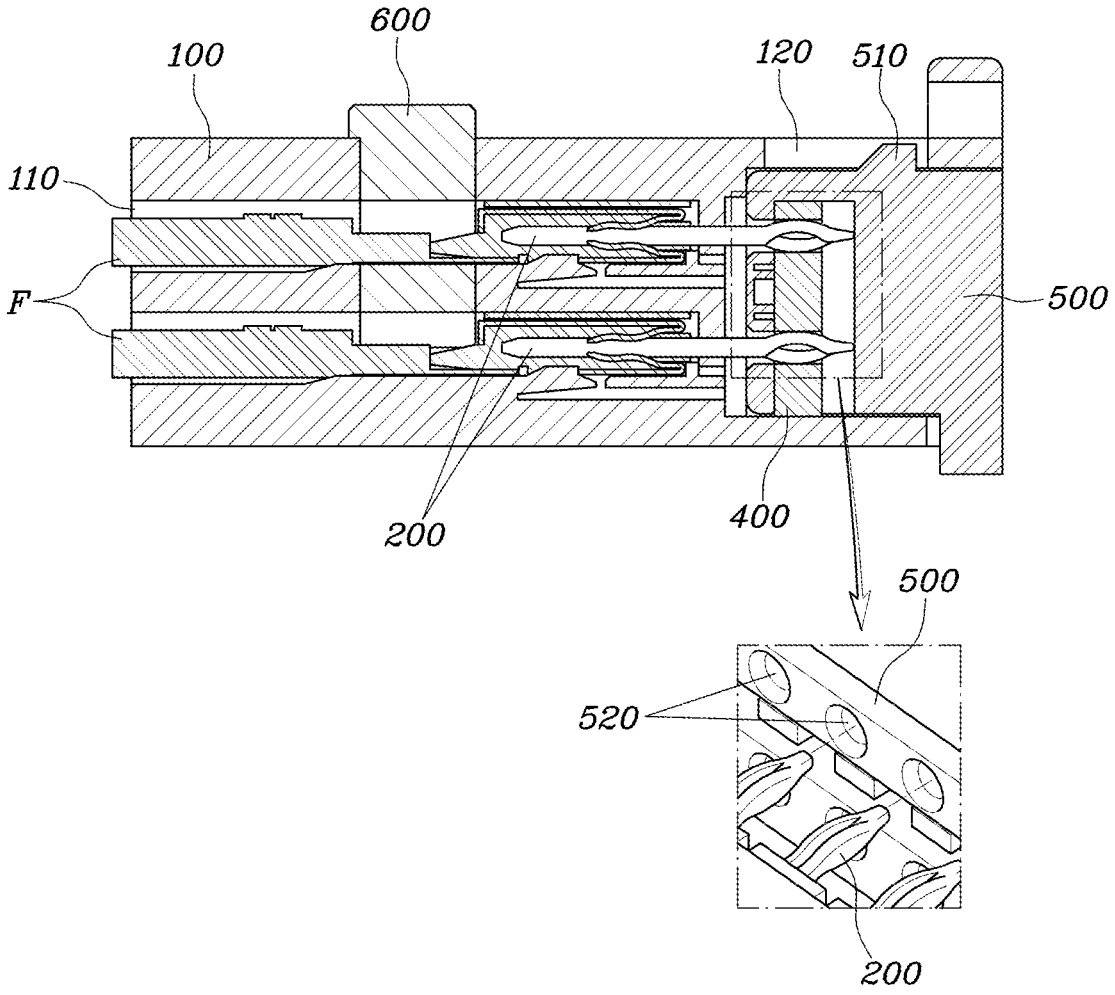
FIG. 8 is a cross-sectional view of FIG. 7.

FIG. 7 is a plan view of the other side of the housing 100 into which the insertion fixing unit 500 is inserted according to one form of the present disclosure, and FIG. 8 is a cross-sectional view of FIG. 7.

Referring to FIGS. 7 and 8, the plurality of female-type terminals F may be inserted through the accommodating grooves 110 at the one side of the housing 100. Particularly, the plurality of terminals F may be electrically connected to the connection terminals 200 positioned in the housing 100, respectively.

Particularly, the other end portions of the connection terminals 200 extending toward the one side of the housing 100 may be electrically connected to the plurality of terminals F in the housing 100.

The one end portions of the connection terminal 220 extending toward the other side of the housing 100 may be inserted into the insertion fixing unit 500 and the circuit board 400 that are inserted into the other side of the housing 100. In particular, the one end portion of the connection terminal 200 may be inserted into the connection hole 410 of the circuit board 400 while being in an elastically deformed state, and may adhere the inner circumferential surface of the connection hole 410 by an elastic force and be electrically connected to the circuit board 400.

Further, the guide hole 520 that is tapered so as to be gradually expanded while extending from the circuit board 400 toward the inside of the housing 100 may be formed in the insertion fixing unit 500 to guide the one end portion of the connection terminal 200 to be inserted into the connection hole 410 of the circuit board 400.

With the connector assembly according to the present disclosure, it is possible to remove noise and reflected waves generated in CAN FD communication.

In addition, the noise filters are disposed between the respective connection terminals on the circuit board of the connection assembly, such that a filtering effect may be improved and product size reduction may be achieved.

Although the present disclosure has been shown and described with respect to specific FORMS, it will be obvious to those skilled in the art that the present disclosure may be variously modified and altered without departing from the spirit and scope of the present disclosure as defined by the following claims.

What is claimed is:

1. A connector assembly comprising:

a housing having a first side and a second side, wherein a plurality of accommodating grooves configured to receive a plurality of terminals are formed in the first side of the housing and the second side is formed with an opening;

a plurality of connection terminals fixed in the housing and configured to extend in a direction parallel to a direction from the first side of the housing toward the second side of the housing;

a circuit board inserted into the opening formed in the second side of the housing, fixed to the housing, and electrically connected to the plurality of connection terminals;

noise filters configured to filter out electromagnetic interference and coupled to the circuit board; and a terminal position assurance (TPA) mechanism inserted into the housing in a direction intersecting a direction in which the plurality of accommodating grooves extend, and configured to inhibit the plurality of terminals inserted into the accommodating grooves from being separated.

2. The connector assembly of claim 1, wherein the circuit board has a plurality of connection holes, and first end portions of the plurality of connection terminals are electrically connected to the circuit board in a state of penetrating through the plurality of connection holes.

3. The connector assembly of claim 2, wherein the first end portions of the plurality of connection terminal are inserted into the connection hole while being in an elastically deformed state, and adhere an inner circumferential surface of the plurality of connection holes by an elastic force.

4. The connector assembly of claim 1, wherein a plurality of connection holes are formed in the circuit board while being spaced apart from each other in a plane direction, and the noise filters are in a form of a plurality of beads positioned between the plurality of connection holes that are spaced apart from each other.

5. The connector assembly of claim 1, further comprising an insertion fixing unit integrally fixed to the circuit board while enclosing the circuit board, inserted into the second side of the housing that is open, and fixed to the housing.

6. The connector assembly of claim 5, wherein the circuit board has a plurality of connection holes, and the insertion fixing unit has guide holes penetrating toward an inside of the housing at positions corresponding to the plurality of connection holes.

7. The connector assembly of claim 6, wherein the guide holes are tapered and configured to gradually expand while extending from the circuit board toward the inside of the housing.

8. The connector assembly of claim 5, further comprising:

a locking fixing portion protruding upward, and configured such that a portion of the locking fixing portion that faces an inner side of the housing is tapered and a portion of the locking fixing portion that faces an outer side of the housing is stepped, and is formed on an upper surface of the insertion fixing unit, wherein a locking rotation portion is formed on an upper surface of the housing and includes a locking hole into which the locking fixing portion is inserted as the insertion fixing unit is inserted into the opening of the second side of the housing.

9. The connector assembly of claim 8, wherein a first end portion of the locking rotation portion is rotatably coupled to the upper surface of the housing, and a second end portion of the locking rotation portion is tapered upward.

10. The connector assembly of claim 1, wherein the plurality of connection terminal is inserted from the second side of the housing toward the first side of the housing, and each connection terminal of the plurality of connection terminals has an expanded portion that is expanded outward and is configured to block insertion into the housing at a preset position.

11. The connector assembly of claim 10, wherein a protrusion that protrudes outward and comes into contact with the housing is formed on each connection terminal of the plurality of connection terminal, and the protrusion is formed so that a portion that faces the first side of the housing is tapered and a portion that faces the second side of the housing is stepped.

12. The connector assembly of claim 1, wherein the noise filters are ferrite cores that filter out noise included in a signal input to or output from the circuit board through the plurality of connection terminals.

* * * * *